United States Patent [19]

Hobes et al.

[11] Patent Number: 4,772,673

[45] Date of Patent: Sep. 20, 1988

[54] ETHYLENE COPOLYMERS

[75] Inventors: John Hobes, Dinslaken; Karl H. Heier, Frankfurt, both of Fed. Rep. of Germany

[73] Assignee: Ruhrchemie Aktiengesellschaft, Fed. Rep. of Germany

[21] Appl. No.: 38,544

[22] Filed: Apr. 15, 1987

Related U.S. Application Data

[60] Continuation-in-part of Ser. No. 930,707, Nov. 13, 1986, which is a division of Ser. No. 755,294, Jul. 15, 1985, abandoned, which is a division of Ser. No. 563,907, Dec. 21, 1983, abandoned.

[30] Foreign Application Priority Data

Dec. 23, 1983 [DE] Fed. Rep. of Germany ..... 3247753

[51] Int. Cl.[4] ..... C08F 20/40; C08F 20/18

[52] U.S. Cl. ..... 526/316

[58] Field of Search ..... 526/316, 287, 286, 264

[56] References Cited

U.S. PATENT DOCUMENTS

| | | | |
|---|---|---|---|
| 3,591,502 | 7/1971 | Ilnyckyj | 44/62 |
| 3,853,814 | 12/1974 | Guillet | 526/316 |
| 4,230,843 | 10/1980 | Coleman | 526/316 |
| 4,245,076 | 1/1981 | Marquardt | 526/320 |

FOREIGN PATENT DOCUMENTS 7400028 7/1974 Netherlands .

*Primary Examiner*—Christopher Henderson
*Attorney, Agent, or Firm*—Charles A. Muserlian

[57] ABSTRACT

Waxy highly branched copolymers having a molecular weight of 500 to 20,000 comprised of at least 60% by weight of ethylene, 1 to 39% by weight of an alkene carboxylic acid ester and/or a vinyl ester and 1–30% by weight of a vinyl ketone produced by polymerization at 100 to 350° C. and a pressure of about 1,000 to 8,000 bar in the presence of a radical forming initiator and in the absence of a solvent useful as oil additives to improve flow characteristics of crude oils and middle distillates derived from crude oil.

7 Claims, No Drawings

ETHYLENE COPOLYMERS

PRIOR APPLICATION

This application is a continuation-in-part of copending U.S. patent application Ser. No. 930,707 filed Nov. 13, 1986 which is a division of U.S. patent application Ser. No. 755,294 filed July 15, 1985, now abandoned, which is a continuation of U.S. patent application Ser. No. 563,907 filed Dec. 21, 1983, now abandoned.

ETHYLENE COPOLYMERS AS MINERAL OIL ADDITIVES

The present invention relates to the use of copolymers of ethylene as pour-point depressants and flow improvers for crude oils and middle distillation fractions obtained from crude oil.

Economically speaking, the principal pour-point depressants and flow improvers for crude oils and middle distillates derived therefrom are copolymers of ethylene with esters of vinyl alcohol, in particular vinyl acetate. Such mixed polymers and their applications are described, for example, in DOS No. 19 14 756 and DOS No. 25 15 805. Copolymers of ethylene and vinyl methyl ketone are disclosed in British Pat. No. 1,235,836 as flow improvers. These copolymers are generally produced in autoclaves at temperatures of 80° to 150° C. and pressures of 50 to 150 bar. Peroxides are used as initiators and the reaction is carried out in the presence of organic solvents.

The subject of the present invention is waxy highly branched copolymers having a molecular weight of 500 to 20,000 comprised of at least 60% by weight of ethylene, 1 to 39% by weight of an alkene carboxylic acid ester and/or a vinyl ester and 1–30% by weight of a vinyl ketone produced by polymerization at 100° to 350° C. and a pressure of about 1,000 to 8,000 bar in the presence of a radical forming initiator and in the absence of a solvent. Optionally, minor amounts of other conventional monomers which can be copolymerized with ethylene may be included. This invention also encompasses the use of these copolymers as flow improvers for mineral oils. Preferable oils include crude oil and middle distillation fractions obtained therefrom. However, the invention can be practiced with any oil.

Surprisingly, it has been found that waxy copolymers of ethylene containing, not only alkene carboxylic acid esters and/or vinyl esters, but also vinyl ketones, considerably improve the flow characteristics of these oils. The improvement in flowability is not merely the additive effect of the number of esters and vinyl ketone units in the ethylene copolymers. Rather the effect of the ester and vinyl ketone units is amplified synergistically.

Preferably the copolymers contain 75 to 94% by weight of ethylene monomers, 5 to 15% by weight of alkene carboxylic acid esters, and 1 to 10% by weight of vinly ketones.

The ethylene copolymers used in the process according to the invention are produced by polymerizing the monomer mixture at temperatures of 100° to 350° C. and high pressures of 1000 to 8000 bar in the presence of radical-forming initiators. The polymerization does not require the presence of a solvent; therefore, solvent-free products are obtained directly.

The ethylene used as a starting material is at least about 99.9% pure as is customary for polymerization reactions. Esters of alkene carboxylic acids having 3 to 12 carbon atoms with primary, secondary and tertiary alcohols having 1 to 8 carbon atoms can advantageously be used as the alkene carboxylic acid esters. Examples thereof are methyl acrylate, ethyl acrylate, butyl acrylate, or 2-ethylhexyl acrylate. Examples of vinyl esters are vinyl acetate and vinyl propionate. Vinyl acetate is especially preferred. Vinyl ketones of the invention include alkyl vinyl ketones with an alkyl portion of 1–8 carbon atoms; e.g., vinyl methyl ketone, vinyl ethyl ketone, and vinyl propyl ketone. In particular, vinyl methyl ketone is preferred.

Standard monomers copolymerizable with ethylene can also be included in the copolymers. They are, for example, alkenes having 3 to 8 carbon atoms; vinyl and alkenyl ethers; vinyl and alkenyl alcohols; N-vinyl and N-alkenyl compounds such as N-vinyl pyrrolidone, N-vinyl carbazole, N-vinyl caprolactam, acrylamide, and methacrylamide; acrylic and methacrylic nitriles; alkenyl ketones; vinyl and alkenyl sulfones, sulfonates, and dicarbonates; acid anhydrides; and styrene.

Polymerization takes place in the presence of catalytic amounts of radical-forming initiators; e.g. oxygen in amounts of 2 to 250 mol-ppm, based on the amount of ethylene to be polymerized. Other suitable initiators are peroxides; e.g. tertiary butyl perbenzoate, dilauroyl peroxide, and di-tert.-butyl peroxide; and azo-bis-isobutyronitrile, preferably in amounts of 2 to 200 mol-ppm, based on the ethylene. The molecular weights are adjusted by moderators such as aliphatic alcohols and/or carbonyl compounds; saturated, unsaturated or chlorinated hydrocarbons; or hydrogen. Depending on the molecular weight required, they are used in concentrations of between 2 and 25 vol.-%, based on the ethylene content of the copolymer. The compounds of the invention generally have a molecular weight of 500 to 20,000, determined according to the method of K. Rast, Report 550, 1922.

The copolymers of the invention described above improve the flow properties of mineral oils such as middle distillation fractions obtained from crude oil, as well as those of crude oil itself. They influence the crystal growth of the paraffin, which precipitates out under cold conditions, so that the paraffin crystals remain small and do not agglomerate. Therefore, the small crystals are able to pass through filters.

These copolymers are added to the mineral oil in any convenient form. However, a 40 to 50% solution in an aromatic hydrocarbon is preferred. The amount of copolymer used should be 0.001 to 2%, preferably 0.005 to 0.5% by weight based on the mineral oil.

The compounds of the invention can be used alone or together with other oil additives generally known in the art. The additives can typically be other pour-point depressants, or dewaxing agents, corrosion inhibitors, antioxidants, or sludge inhibitors. Moreover, in addition to their use as flow improvers, copolymers are also suitable as adhesives, as coating materials, and for mixing with other materials, especially waxes, whose properties they improve.

The polymers of the present invention are highly branched, i.e. have a number of short aliphatic side chains per polymer molecule as compared to known polymers such as those described in U.S. Pat. No. 3,591,502 which are produced by low pressure polymerization. The high degree of branching creates steric arrangements within the molecule resulting in excellent flow improver properties which the prior art polymers lack. The degree of branching in the polymers of the invention is 10 to 30 methyl groups per 1,000 methylene groups of the polymer chain, preferably 15 to 25.

In the following examples, which further explain but do not limit the invention, the improvement in flow characteristics of middle distillate fractions obtained from crude oil using the ethylene copolymers of the invention is demonstrated with the Cold Filter Plugging Point (CFPP) test. This test is described in the J. of the Inst. of Petr., Volume 52, June 1966, pages 173 to 185 and in DIN 51 428. It determines the temperature at which the treated oil will no longer flow through a standard filter, thereby giving a measure of flow properties of the test oil.

COMPARATIVE EXAMPLE A

A middle distillate rich in paraffins with an initial boiling point of 175° C., 5% point at 195° C., 95% point of 365° C., final boiling point of 383° C., and a CFPP value of 5° C. is mixed with 200 ppm (based on the distillate) of an additive. The additive contains 52% of an aromatic hydrocarbon solvent and 48% of a copolymer comprising 80% ethylene and 20% vinyl acetate having a viscosity of 450 mPas measured at 140° C. The middle distillate treated in this way has a CFPP value of 0° C.

COMPARATIVE EXAMPLE B

Comparative Example A is repeated except that a copolymer of 78% ethylene and 22% t-butyl acrylate is used having a viscosity of 550 mPas measured at 140° C. The middle distillate treated in this way has a CFPP value of +1° C.

COMPARATIVE EXAMPLE C

Replacing the copolymer of Comparative Example A with a copolymer of 90% ethylene and 10% methyl vinyl ketone, havng a viscosity of 500 mPas measured at 140° C., additive C is prepared. Comparative Example A was otherwise repeated. The CFPP value obtained therefrom is +1° C.

COMPARATIVE EXAMPLE D

A middle distillate with an initial boiling point of 178° C., 5% point of 201° C., 95% point of 359° C., final boiling point of 376° C., and CFPP of −4° C. is mixed with 200 ppm of an additive containing 52% of an aromatic hydrocarbon solvent and 48% of a copolymer comprising 76% ethylene and 24% vinyl acetate having a viscosity of 1,600 mPas when measured at 140° C. The middle distillate treated in this manner has a CFPP value of −7° C.

EXAMPLE 1

The middle distillate of Comparative Example A is mixed with 200 ppm of an additive containing 52% of an aromatic hydrocarbon solvent and 48% of a terpolymer comprising 80% ethylene, 19% vinyl acetate and 1% methyl vinyl ketone having a viscosity of 440 mPas at 140° C. The distillate treated in this way has a CFPP value of −3° C.

EXAMPLE 2

The middle fraction of Comparative Example A is mixed with 200 ppm of an additive containing 52% of an aromatic hydrocarbon solvent and 48% of a terpolymer comprising 82% ethylene, 15% t-butyl acrylate and 3% methyl vinyl ketone having a viscosity of 600 mPas at 140° C. The treated distillate has a CFPP value of −4° C.

EXAMPLE 3

The oil fraction of Comparative Example A is mixed with 200 ppm of an additive containing 52% of an aromatic hydrocarbon solvent and 48% of a terpolymer comprising 80% ethylene, 15% vinyl acetate and 5% methyl vinyl ketone having a viscosity of 1,480 mPas at 140° C. The distillate so treated has a CFPP value of −4° C.

EXAMPLE 4

The middle distillate of the Comparative Example A is mixed with 200 ppm of an additive containing 52% of an aromatic hydrocarbon solvent and 48% of terpolymer comprising 85% ethylene, 5% vinyl acetate and 10% vinyl methyl ketone having a viscosity of 560 mPas at 140° C. The middle distillate treated in this manner has a CFPP value of −6° C.

EXAMPLE 5

The distillate of Comparative Example D is mixed with 200 ppm of an additive containing 52% of an aromatic hydrocarbon solvent and 48% of a terpolymer comprising 80% ethylene, 10% vinyl acetate and 10% methyl vinyl ketone having a viscosity of 1,450 mPas measured at 140° C. The CFPP value of the treated distillate is −14° C.

EXAMPLE 6

The difference in the degree of branching between the products of Examples 1 and 4 and of U.S. Pat. No. 3,591,502 was determined by $^1$H-NMR spectroscopy to ascertain the terminal methyl groups resulting from vinyl acetate and methyl vinyl ketone units. Only the average No. of methyl groups of the aliphatic side chains were determined per 1,000 methylene groups in the polymer chain. The product of Example 1 contained 19% by weight of vinyl acetate and 1% by weight of methyl vinyl ketone and the product of Example 4 containe 5% by weight of vinyl acetate and 10% by weight of methyl vinyl ketone. The prior art product was that of comparative test E of Example 7. The results are reported in the following Table.

TABLE

| Product of Example | Degree of braching $CH_3$/1,000 $CH_2$ |
|---|---|
| 1 | 16.8 |
| 4 | 22.3 |
| prior art | 2.1 |

The table shows that the polymers of the invention are 8 to 10 times more highly branched than the polymers of U.S. Pat. No. 3,591,502.

EXAMPLE 7

E. Comparison Test 1 (according to Ilnyckyjl U.S. Pat. No. 3,591,502

A clean autoclave (volume 1.0 liters) was rinsed with $N_2$ and then with ethylene and 200 ml of toluene and 2.8 g of methyl vinyl ketone were placed in the autoclave. (Benzene is not permitted to be used as a solvent in Germany because it is hazardous to health. Otherwise the Ilnyckyj procedure is followed). The mixture was heated to 155° C. (about 310° F.) with stirring, and then ethylene was added until a pressure of 70 bar (about 1000 psig) was achieved. Under these constant conditions (155° C./70 bar), 50 ml of a solution of 15% dibutyl peroxide in toluene were added over a period of 1.5 hours. A total of 11.2 g of methyl vinyl ketone were simultaneously added over a period of 1.25 hours. Upon completion of the addition, the mixture was left to post-react for 1.5 hours at 155° C. and 70 bar with stirring. It was then cooled down to 65° C. (150° F.) and the product mixture was removed from the autoclave. After the solvent and the unconverted monomers were separated, a solid matter of 55 g was obtained which contained 11.8% by weight of methyl vinyl ketone and had a molecular weight of 2100 (determined osmometrically).

F. Comparison Test 2 (Production of terpolymers according to Ilnyckyj U.S. Pat. No. 3,591,502)

Test E was repeated exactly, except that the 11.2 g of methyl vinyl ketone which were added over 1.25 hours was replaced with 7 g of methyl vinyl ketone and 12 g of vinyl acetate. After the solvent and the unconverted monomers were separated, a solid matter of 57 g was obtained which contained 5.2% by weight of methyl vinyl ketone and 8.4% by weight of vinyl acetate, and which had a molecular weight of 2050 (determined osmometrically).

To test the polymers obtained in Tests E and F with the product of Example 5, they were dissolved in kerosene (1 part polymer to 1 part kerosene) and admixed with testing oils. Testing oil I corresponded to the "middle distillate" of Comparative Example A while testing oil II to the "middle distillate" of Comparative Example D. The CFPP value was obtained for testing oils I and II without any additive and with varying amounts of additive present and the results are set forth in the following Tables 1 through 3.

TABLE 1

| Product from Test No. 1 | | | | | | |
|---|---|---|---|---|---|---|
| Quantity (ppm) | 0 | 100 | 400 | 0 | 100 | 400 |
| Testing Oil | I | I | I | II | II | II |
| CFPP value | +5° C. | +5° C. | +5° C. | −4° C. | −4° C. | −4° C. |

TABLE 2

| Product from Test No. 2 | | | | | | |
|---|---|---|---|---|---|---|
| Quantity (ppm) | 0 | 100 | 400 | 0 | 100 | 400 |
| Testing Oil | I | I | I | II | II | II |
| CFPP-value | +5° C. | +5° C. | +5° C. | −4° C. | −4° C. | −4° C. |

TABLE 3

| Product: 1:1 mixture of product from Test 1 and Example 5 of the invention | | | | | | |
|---|---|---|---|---|---|---|
| Quantity (ppm) | 0 | 100 | 400 | 0 | 100 | 400 |
| Testing Oil | I | I | I | II | II | II |
| CFPP value | +5° C. | +5° C. | +5° C. | −4° C. | −4° C. | −4° C. |

The results of the tables clearly show that neither the product from Test E nor that from Test F have any effect as a flow improving agent. The CFPP values are unaffected by the product of either Test E or Test F in amounts up to 400 ppm of additive (200 ppm of polymer). 200 ppm of additive (100 ppm of the terpolymer of Example 5) changed the CFPP of testing II from −4 to −14. Clearly, Ilnyckyj does not reach or suggest the flow improving additives of the invention and obviously leads to clearly different products. Furthermore, Table 3 shows the effect of a mixture of the product of Test F and Example 5 polymer on flow properties wherein 1:1 mixture was used. The flow improving characteristics shown by the polymer of Example 5 are completely eliminated by its mixture with the Ilnyckyj type terpolymer.

Various modifications of the products and method of the invention may be made without departing from the spirit or scope thereof and it is to be understood that the invention is intended to be limited only as defined in the appended claims.

What we claim is:

1. Waxy highly branched copolymers having a molecular weight of 500 to 20,000 comprised of 75 to 94% by weight of ethylene, 1 to 15% by weight of an alkene carboxylic acid ester and/or a vinyl ester and 1 to 10% by weight of a vinyl ketone product by polymerization at 100° to 350° C. and a pressure of about 1,000 to 8,000 bar in the presence of a radical forming initiator and in the absence of a solvent and having 10 to 30 methyl groups branches per 1,000 methylene groups in the polymer.

2. Waxy highly branched copolymers having a molecular weight of 500 to 20,000 comprised of 75 to 94% by weight of ethylene, 5 to 15% by weight of an ester of alkene carboxylic acids of 3 to 12 carbon atoms and primary, secondary, or tertiary alcohols of 1 to 8 carbons atoms and/or vinyl acetate and 1 to 10% by weight of methyl vinyl ketone by polymerization at 100° to 350° C. and a pressure of about 1,000 to 8,000 bar in the presence of a radical forming initiator and in the absence of a solvent and having 10 to 30 methyl groups branches per 1,000 methylene groups in the polymer.

3. A copolymer of claim 1 wherein said alkene carboxylic acid esters comprise 5 to 15% by weight of said copolymers.

4. A copolymer of claim 1 wherein said vinyl ketone monomer comprises 1 to 10% by weight of said copolymers.

5. A copolymer of claim 1 wherein said alkene carboxylic acid esters are selected from the group consisting of esters of alkene carboxylic acids of 3 to 12 carbon atoms with primary, secondary of tertiary alcohols of 1 to 8 carbon atoms.

6. A copolymer of claim 1 wherein said vinyl ester is vinyl acetate.

7. A copolymer of claim 1 wherein said vinyl ketone monomer is methyl vinyl ketone.

* * * * *